US010569927B2

(12) United States Patent
Herkenrath

(10) Patent No.: US 10,569,927 B2
(45) Date of Patent: Feb. 25, 2020

(54) TAMPERPROOF FOOD BOX

(71) Applicant: Michael Herkenrath, Campbell, CA (US)

(72) Inventor: Michael Herkenrath, Campbell, CA (US)

( * ) Notice: Subject to any disclaimer, the term of this patent is extended or adjusted under 35 U.S.C. 154(b) by 143 days.

(21) Appl. No.: 14/690,545

(22) Filed: Apr. 20, 2015

(65) Prior Publication Data

US 2016/0304234 A1 Oct. 20, 2016

(51) Int. Cl.

| | |
|---|---|
| ***B65D 5/54*** | (2006.01) |
| ***B65D 5/32*** | (2006.01) |
| ***B65D 43/16*** | (2006.01) |
| ***B65D 33/18*** | (2006.01) |
| ***B65D 33/12*** | (2006.01) |
| ***B65D 33/34*** | (2006.01) |

(52) U.S. Cl.

CPC ..... *B65D 5/54* (2013.01); *B65D 5/321* (2013.01); *B65D 5/546* (2013.01); *B65D 33/12* (2013.01); *B65D 33/18* (2013.01); *B65D 33/34* (2013.01); *B65D 43/162* (2013.01); *B65D 2101/0038* (2013.01)

(58) Field of Classification Search

CPC ..... B65D 5/54; B65D 5/321; B65D 5/546; B65D 33/12; B65D 33/18; B65D 33/34; B65D 43/162; B65D 43/0235; B65D 2101/00; B65D 2101/0038; B65D 2585/366; B65D 5/46

USPC .... 229/221, 906, 240, 242, 227, 102, 123.2, 229/235, 243, 238, 239

See application file for complete search history.

(56) References Cited

U.S. PATENT DOCUMENTS

| | | | | |
|---|---|---|---|---|
| 2,680,558 A | | 6/1954 | Mai | |
| 3,206,103 A | * | 9/1965 | Bixler | B65D 5/5415 206/807 |
| 5,161,734 A | * | 11/1992 | Ruehl | B65D 5/5415 229/147 |
| 5,261,595 A | * | 11/1993 | Nanno | B65D 5/3628 229/117.01 |
| 5,358,176 A | | 10/1994 | Rigby | |
| 5,673,849 A | * | 10/1997 | Stone | B65D 5/0263 229/130 |
| 5,803,345 A | | 9/1998 | Jones et al. | |
| 6,059,178 A | | 5/2000 | Malloy et al. | |
| 6,398,028 B1 | | 5/2002 | Stovall | |
| 6,685,085 B2 | | 2/2004 | Hanna | |
| 7,712,626 B2 | | 5/2010 | Vovan | |

(Continued)

FOREIGN PATENT DOCUMENTS

DE 202011107836 12/2011

*Primary Examiner* — Christopher R Demeree

(57) ABSTRACT

A re-closable tamperproof food box, including first and second main panels connected with a rear panel, the first main panel forming the bottom and the second main panel forming the top. The first main panel has two side panels and a front panel attached. The second main panel has two side panels and a front panel attached. The second main panel is connected along fourth edge to the rear panel connected along a fourth edge of the first main panel. At least one strip of adhesive is disposed on one of the two opposing side panels and the front panel of the first main panel A perforation is disposed along the second main panel, forming a tear strip. A continuous length of material on an interior surface of the second main panel, to tear through the tear strip.

20 Claims, 11 Drawing Sheets

(56) References Cited

U.S. PATENT DOCUMENTS

| | | | | |
|---|---|---|---|---|
| 8,408,451 | B2 | 4/2013 | Adam et al. | |
| 2004/0149624 | A1* | 8/2004 | Wischusen | B65D 5/54 206/736 |
| 2006/0124708 | A1 | 5/2006 | Lo Duca | |
| 2008/0302808 | A1 | 12/2008 | Maxwell | |
| 2011/0290809 | A1 | 12/2011 | Liebowitz et al. | |
| 2012/0037692 | A1 | 2/2012 | Fitzwater | |
| 2014/0305944 | A1* | 10/2014 | Lahlouh | B65D 5/2076 220/359.2 |
| 2016/0304235 | A1 | 10/2016 | Herkenrath | |

* cited by examiner

TAMPERPROOF FOOD BOX

TECHNICAL FIELD OF THE INVENTION

The present invention relates to a food delivery container and more particularly to a food delivery container that is tamper proof.

BACKGROUND OF THE INVENTION

In recent years it has become increasingly popular to deliver prepared foods such as vegetable plates, sandwiches, french fries, pizzas, meats, ethnic foods, deserts and the like. Companies and restaurants which provide to go and home food delivery services are constantly seeking ways to improve the service, food quality and taste due to the competitive nature of the business. For example, food is typically delivered in an insulated container. The purpose is to keep food hot and tasty and retain attributes such as crispiness, texture, etc.

Tamper-proof packaging arrangements are often provided on various consumer products such as medicines, and also on packaging for various food products. These arrangements typically include locking structures which, when tampered with, enable the consumer to easily visually recognize such tampering so that the product can then be rejected. An example of such a tamper-evident structure is a plastic locking ring connected to a cap such as those utilized on beverages. When the cap is loosened to open the container, the ring disconnects from the cap and thus provides a visual clue to the consumer in the event that the container was opened by an unauthorized person. Another type of tamper-evident feature is a plastic strip or seal which is provided externally around an opening of a container which must be removed or torn off prior to opening the container. If this strip is missing or damaged, the consumer can reject the product. In both of the above arrangements, the tamper-evident structure essentially locks the container in the closed position, and opening of the container can only be achieved by damaging or removing the locking structure.

SUMMARY OF THE INVENTION

According to an embodiment of the present invention, there is disclosed a re-closable tamperproof food box having a tamper-evident closure. The food box includes first and second main panels being connected with a rear panel, the first main panel forming the bottom of the food box and the second main panel forming the top of the food box. The first main panel has two opposing side panels attached to first and second edges of the first main panel and a front panel attached to a third edge of the first main panel. The second main panel has two opposing side panels attached to first and second edges of the second main panel and a front panel attached to a third edge of the second main panel. The second main panel is connected along fourth edge to the rear panel connected along a fourth edge of the first main panel. At least one strip of adhesive is disposed on one of the two opposing side panels and the front panel of the first main panel A perforation is disposed along the second main panel, preferably adjacent to the two opposing side panels, and the front panel of the second main panel, forming a tear strip. A continuous length of material on an interior surface of the second main panel is adjacent to the two opposing side panels and the front panel of the second main panel, extending about at least three sides of the food box and secured to the interior surface directly below the tear strip, to tear through the tear strip.

According to an embodiment of the present invention, there is disclosed a re-closable tamperproof take-out food container having a tamper-evident closure. The food container includes an upper portion forming a top half of the container and a lower portion forming the bottom half of the of the container, being hinged together. The upper panel of the upper portion has an upper wall extending therefrom, the upper wall including a rear upper wall, a front upper wall, and first and second upper side walls which are interconnected. A bottom panel of the lower portion has a lower wall extending therefrom, the lower wall including rear lower wall, a front lower wall, and first and second lower side walls which are interconnected. A hinge is located between the rear lower wall attached to the bottom panel and the rear upper wall attached to the top panel for connecting the upper portion and the lower portion, whereby the upper portion folds onto the lower portion. At least one strip of adhesive is disposed on one of the first and second lower side walls and the front lower wall. A perforation is disposed along the upper wall including the front upper wall, and the first and second upper side walls, forming a tear strip. A continuous length of material is on an interior surface of the upper wall including the front upper wall, and the first and second upper side walls, extending about three sides of the food container and is directly behind the tear strip, to tear through the tear strip.

According to another embodiment of the present invention, there is disclosed a re-closable tamperproof food box having a tamper-evident closure. The food box includes first and second main panels which form the top and bottom of the box. The the first main panel includes two side panels, and front and rear panels folded upwardly from a bottom panel to form the bottom of the box. The second main panel includes two side panels, and front and rear panels folded downwardly from a top panel to form the top of the box. At least one strip of adhesive is disposed on the two side panels, the front panel and the rear panel of the bottom of the box whereby when the two side panels and the front and rear panel of the top of the box are pressed against the side panels, the front panel and rear panel of the bottom of the box, the top of the box is secured to the bottom of the box. A perforation is disposed along the second main panel, preferably adjacent to the two side panels, and the front panel of the second main panel, forming a tear strip. A continuous length of material is on an interior surface of the second main panel adjacent to the two side panels and the front panel of the second main panel, extending about at least three sides of the food box and secured to the interior surface directly below the tear strip, to tear through the tear strip.

According to another embodiment of the present invention, there is disclosed a re-closable tamperproof food box having a tamper-evident closure. The food box includes first and second main panels which form the top and bottom of the box. The first main panel includes two side panels, and front and rear panels folded upwardly from a bottom panel to form the bottom of the box. The second main panel includes two side panels, and front and rear panels folded against an inner surface of a lid panel and then folded downwardly to form the top of the box. At least one strip of adhesive is disposed on an inner surface of the two side panels, the front panel and the rear panel of the top of the box whereby when the two side panels and the front and rear panel of the top of the box are pressed against the side panels, the front panel and rear panel of the bottom of the box, the top of the box is secured to the bottom of the box. A perforation is disposed along the second main panel, preferably adjacent to the two side panels, and the front panel of the second main panel, forming a tear strip. A continuous length of material is on an interior surface of the second main panel adjacent to the two side panels and the front panel of the second main panel, extending about at least three sides of the food box and secured to the interior surface directly below the tear strip, to tear through the tear strip.

According to another embodiment of the present invention, there is disclosed a tamperproof bag into which other food delivery containers may be placed. The bag is constructed of a single sheet of material that may folded and bonded and that is suitably strong for transporting storing food items. The bag includes first and second main panels which are connected by side panels and a bottom panel, and a sealant to secure upper ends of the first and second main panels. A perforation extends across the first main panel and across both side panels, forming a tear strip. A continuous length of material, extending about the first main panel and both side panels and secured to their interior surfaces directly below the tear strip, is used to tear through the tear strip.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
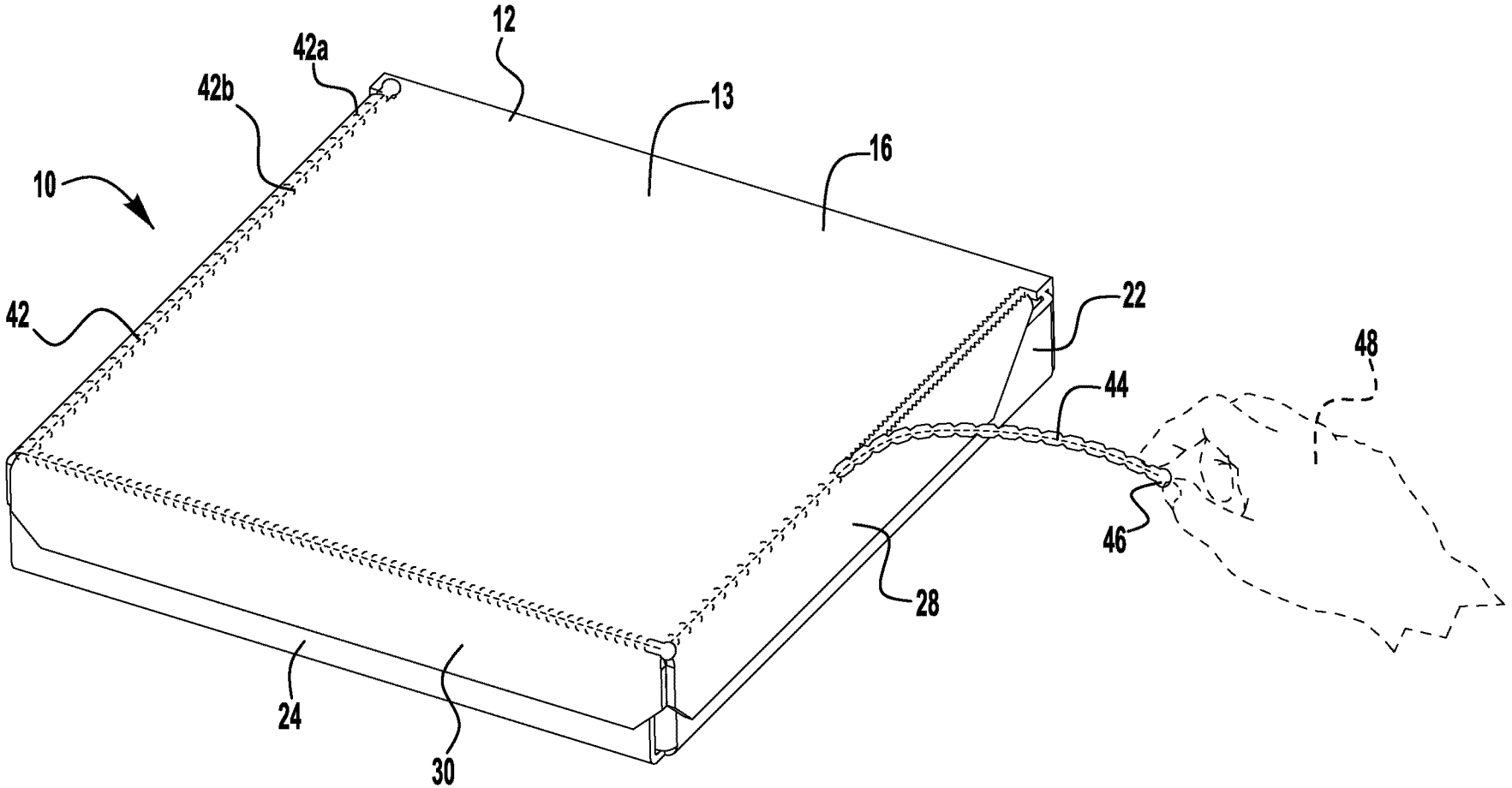
FIG. 1 is a front three dimensional view of the tear strip of the tamperproof food box being opened, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

It has become common practice for consumers to "order out" for food to go, such as pizza, have it delivered to their homes, and then "dine in." Food containers for delivery are well known, such as traditional pizza boxes. However, a limitation or concern with food delivery containers is potentially malicious ingress into such containers that can lead to inadvertent or intentional contamination of the contents of the food container. Thus, there is a need and demand for tamper-resistant and tamper-evident food packaging systems to ensure to the customer that there has been no tampering with the delivered food. The tamper proof food container 10, as shown in FIG. 1, is a tamper proof food box 12 which may be readily opened for use and reclosed, if necessary, after partial consumption of the contents. The purpose of the tamperproof food box 12 is to provide an improved food container 10 which could be reseal able, could have a clear top, could be constructed of bio-green materials and which allows a person to easily and quickly establish if the box has been previously opened. Throughout the present specification, any of the containers described can have a clear top or a part of the top clear.

FIG. 1 illustrates a front, three-dimensional view of the tamperproof food box 12. The object of the tamperproof food box 12 is to provide an improved re-closable folding box with a tamper-evident closure. FIG. 1 illustrates a three-dimensional view of a first embodiment of a food container, wherein the tamperproof food box 12 is a pizza box 13, although any food delivery container may be utilized. Typically, the pizza box 13 is constructed of a single sheet of material, such as a corrugated paper material, cardboard, paperboard, plastic or any other material that may creased, folded and bonded, that is suitably rigid for storing food items. Further, the pizza box 13 may be of any suitable dimensions, such as for example 15 inches by 15 inches by 2 inches. However, it should be noted that the food container 10, shown as a tamperproof food box 12, may include any desired type of food container with any appropriate dimensions.

Figure 2:
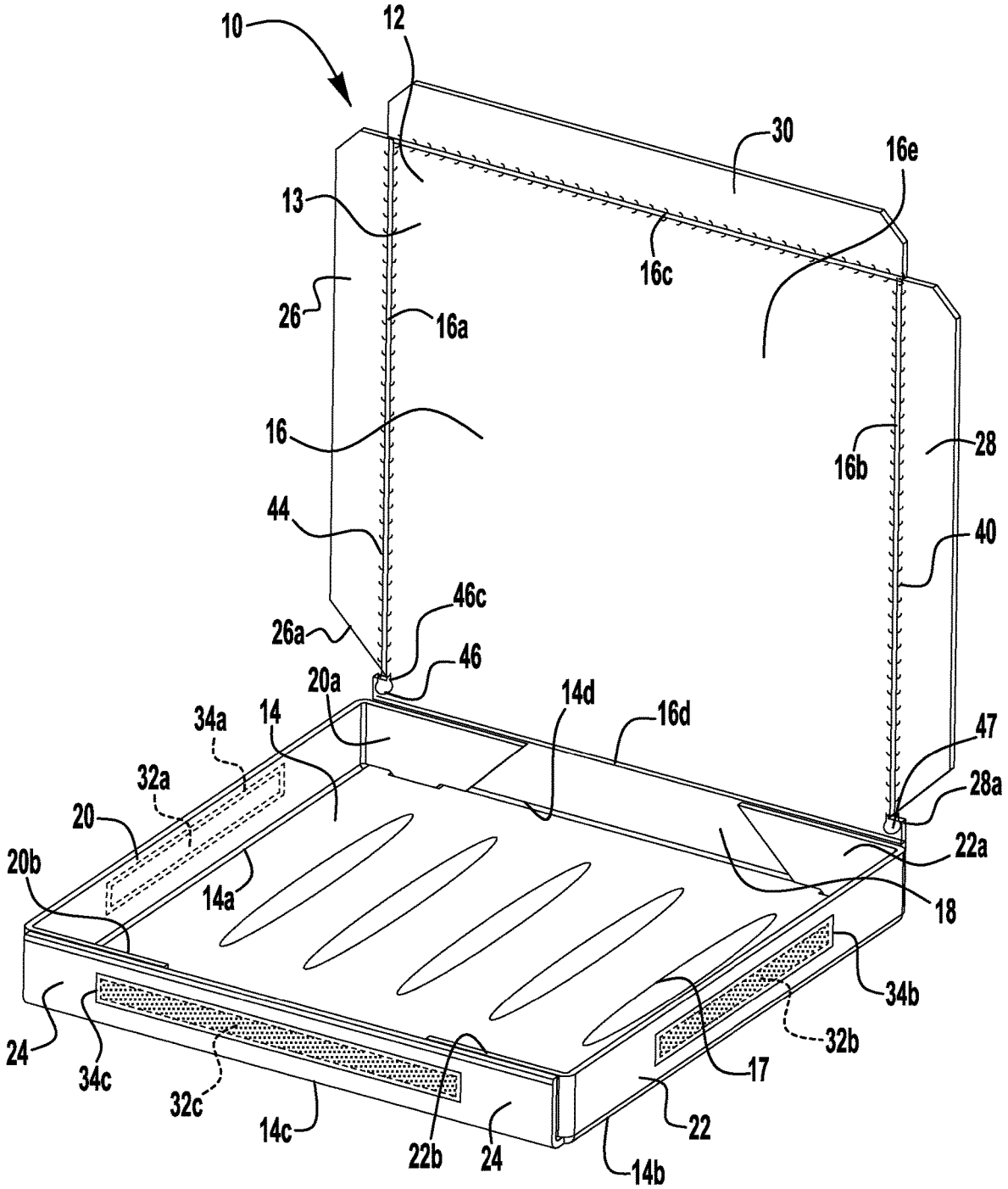
FIG. 2 is a front three dimensional view of the tamperproof food box in an open state, in accordance with the present invention.

As seen in FIG. 2, the tamperproof food box 12 consists of first and second main panels 14 and 16, respectively, which are connected with a narrow rear panel 18. The tamperproof food box 12 can include a clear top and vents in the top or side panels. The first main panel 14 acts as the bottom or tray panel of the food box 12, and the food (not shown) rests thereupon, while the second main panel 16 acts as the lid and top of the food container. Each of the first and second main panels 14 and 16 have a plurality of panels attached thereto. The first main panel 14 has two opposing side panels 20 and 22 attached to first and second edges 14*a* and 14*b*, respectively, and a front panel 24 attached to third edge 14*c*. The second main panel 16 has two opposing side panels 26 and 28 attached to the first and second edges 16*a* and 16*b*, respectively, and a front panel 30 attached to third edge 16*c*. The second main panel 16 is connected along fourth edge 16*d* to the rear panel 18 connected along a fourth edge 14*d* of the first main panel 14.

Typically, the pizza box 13 is shipped to a food establishment flattened and unassembled. To fold and assemble the box 13, the two side panels 20 and 22 and front panel 24 are first folded upwardly from edges 14*a*, 14*b*, and 14*c*, respectively, of the first main panel 14, and the two side panels 26 and 28, and front panel 30 are folded downwardly from edges 16*a*, 16*b* and 16*c*, respectively, of the second main panel 16. The side panels 20 and 22 may each include folding corner tabs, such as corner tabs 20*a* and 20*b* attached to side panel 20 and corner tabs 22*a* and 22*b* attached to side panel 22, which are formed on ends of the side panels to hinge, fold inside, and support the sides and corners of the pizza box 13. Then, the two side panels 26 and 28, and front panel 30 are simply tucked over the side panels 20 and 22 and front panel 24, respectively, to form the pizza box 13. The pizza box 13 has a unique drip containment. The second main panel 14 can include a series of spaced, custom ridges 17 onto which the food is placed to help reduce the amount of moisture absorbed by the food by allowing water, sauce, etc to collect between the ridges as the food is elevated above.

As illustrated in FIG. 2, the food container 12 incorporates a sealing method of securing the two side panels 26 and 28, and front panel 30 to the side panels 20 and 22 and front panel 24, respectively. This sealing method is preferably done with strips of an adhesive, such as an adhesive glue that is preferably bio-green i.e., environmentally friendly. Typically, a strip of adhesive 32*a*, 32*b*, and 32*c* is disposed on the outer facing side of side panels 20 and 22 and front panel 24, respectively. Each of the strips of adhesive 32*a*, 32*b*, and 32*c* are covered with a removable strip of non adhesive liner 34*a*, 34*b*, and 34*c*, respectively. When the food container 12 is constructed, the strips of non adhesive liner 34*a*, 34*b*, and 34*c* are removed from the strips of adhesive 32*a*, 32*b*, and 32*c*. Then, when the two side panels 26 and 28, and front panel 30 are pressed against the side panels 20 and 22 and front panel 24, respectively, they are secured together with the strips of adhesive 32*a*, 32*b*, and 32*c*. The purpose of the securely fastening side and front panels of the lid panel to those of the tray panel with the adhesive 32*a*, 32*b*, and 32*c* is that once the pizza box 13 has been sealed closed with the adhesive, no one may tamper with the food therein until the box reaches the final consumer.

Further, although unnecessary, a cover flap (not shown) may be attached to the second main panel 16, which corresponds to a retainer slot (not shown) within the front panel 24. When the food container 12 is closed, the cover flap may be placed through the retainer slot within the front panel 24 to ensure that the food container remains closed.

As illustrated in FIGS. 1 and 2, preferably there is a perforation 40 disposed along the second main panel 16, preferably adjacent to the two side panels 26 and 28, and front panel 30. The perforation 40 forms a tear strip 42 to provide easy tearing in a direction generally transverse to the tear strip. The tear strip 42 is designed to tear open consistently, with a relatively uniform tearing force, without excessive distortion of the perforation 40. The tear strip can include a pull tab 46 that snaps off. When the box 13 is assembled, the tear strip 42 can be disposed on the second main panel 16 directly above the two side panels 26 and 28, and front panel 30.

As illustrated in FIG. 2, on the interior surface 16*e* of the lid panel 16 adjacent to the two side panels 26 and 28, and front panel 30, respectively, is a continuous length of material, such as plastic or string 44. The material 44 extends about at least three sides of the food container 12 and is secured to the interior surface 16*e* directly below the tear strip 42. A pull tab 46 is attached to an end of the material 44. The pull tab 46 is preferably located below a first end 26*a* of side panel 26, or below a first end 28*a* of side panel 28. Alternatively, as seen in FIG. 2, there may an additional pull tab such as second pull tab 47 below a first end 28*a* of side panel 28. To tear through the tear strip 42, the pull tab 46 is raised by a user 48, as shown in FIG. 1, thereby lifting the material 44 such that it separates the tear strip 42. Although a pull tab 46 is shown, any desired means of lifting the material 44 to tear the tear strip 42 may be utilized, such as a loop attached to the material.

Figure 3:
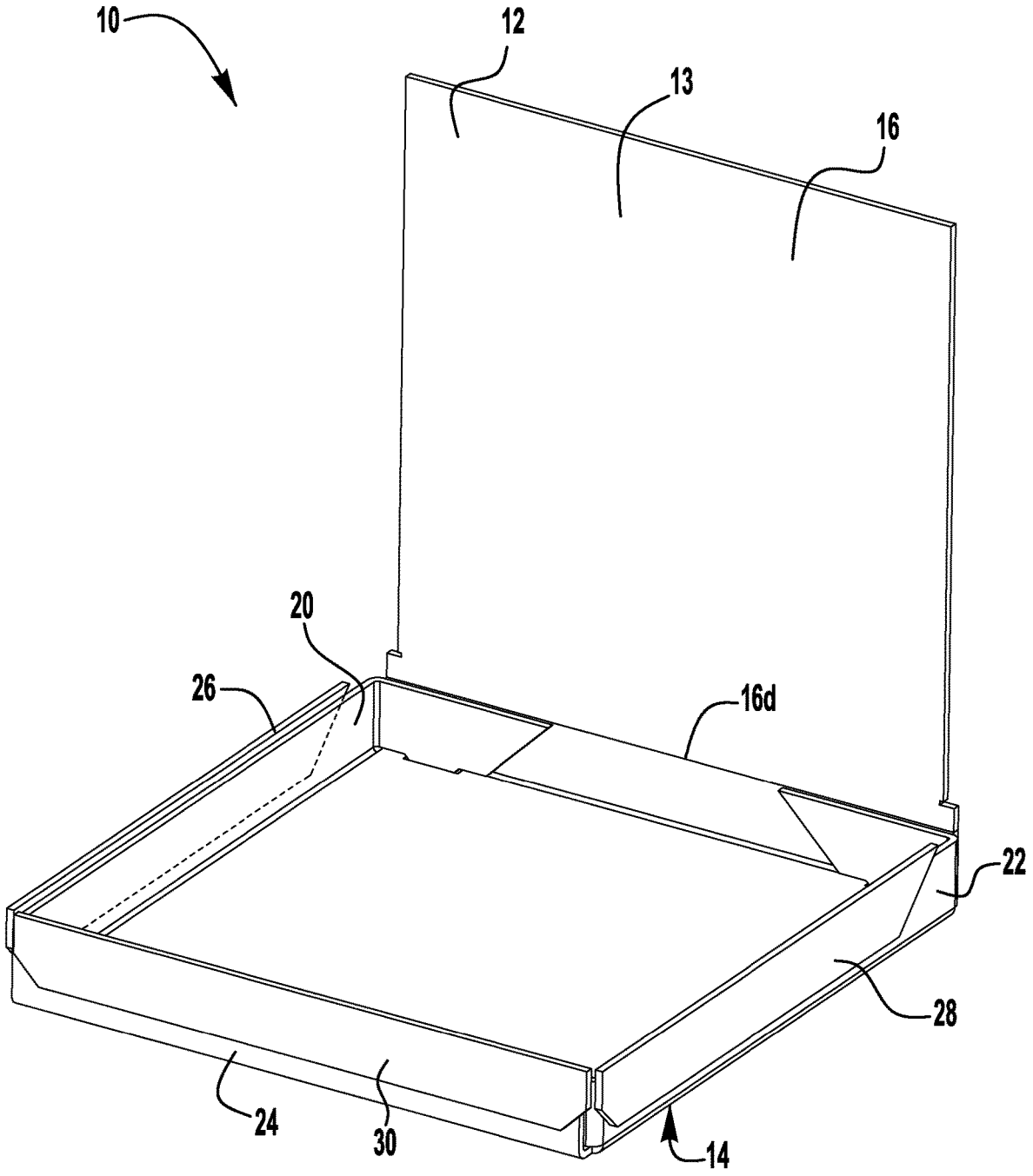
FIG. 3 is a front three dimensional view of the tamperproof food box after it has been opened along the tear strip, in accordance with the present invention.

As shown in FIG. 3, when the tear strip 42 is torn, the second main panel 16 is separated from the side panels 26 and 28, and the front panel 30, which remain adhered to the side panels 20 and 22 and front panel 24 of the first main panel 14 by adhesive strips 32*a*, 32*b* and 32*c*, respectively. Then, the lid 16 of pizza box 13 may be opened about the hinged connection 16*d* to remove the food therein, and the user may be assured that the food has not been tampered with. After the lid is opened, it can re-close in a way that secures the lid, such as with tape or an adhesive.

In use, the pizza or other food is placed within the bottom or tray panel of the food box 12. Then the side and front panels of the lid panel are adhesively secured to those of the tray panel so that once the pizza box 13 has been sealed closed with the green i.e., environmentally friendly, adhesive, no one may tamper with the food therein until the box reaches the final consumer.

Figure 4:
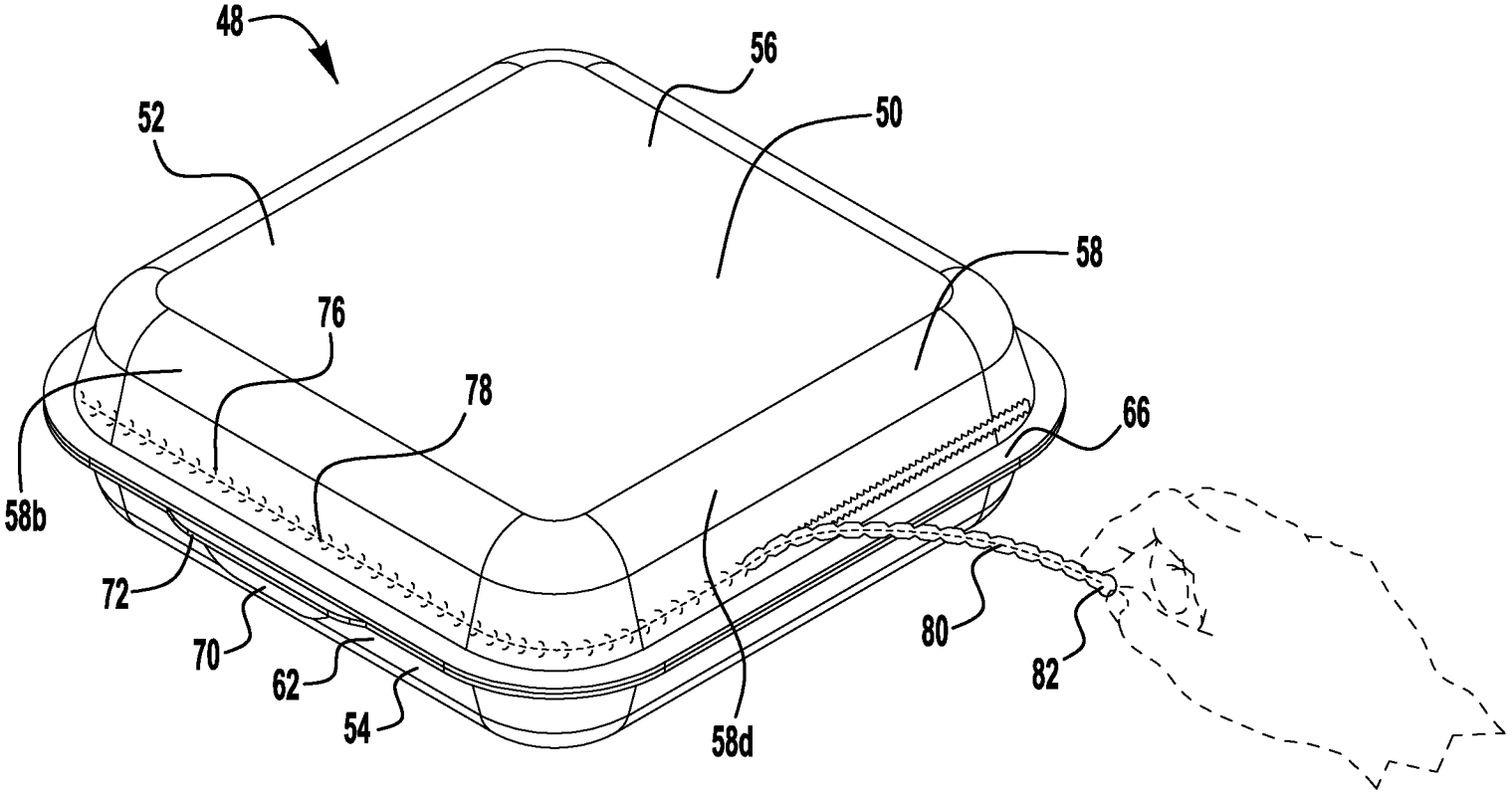
FIG. 4 is a front three dimensional view of an alternative embodiment of the tear strip of the tamperproof food box being opened, in accordance with the present invention.

FIG. 4 illustrates an alternative embodiment of a tamperproof food box 48 which is a take-out food container 50. Food containers 50 can take on many forms from small sandwich containers to large containers to compartmentalized containers. Further, the food containers 50 are not necessarily limited to any one shape. In an exemplary embodiment, the food container 50 may be formed of a material which can not only provide additional strength and ductility to the container, but is also environmentally friendly. For example, the food containers 50 can be formed of a material which is completely recyclable and contains no environmentally hazardous chemicals, such as chlorofluorocarbons (CFC's or HCFC's).

Figure 5:
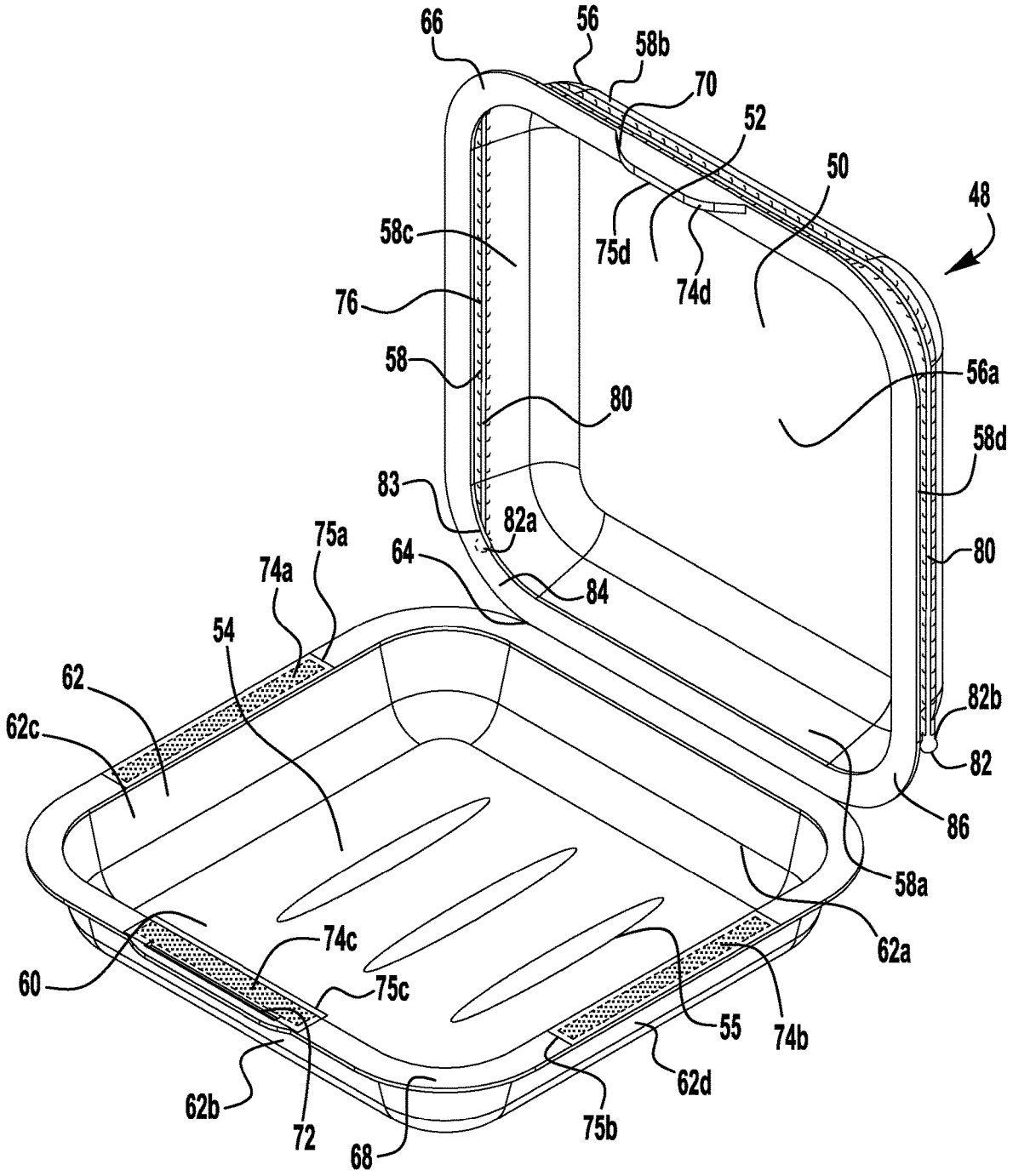
FIG. 5 is a front three dimensional view of an alternative embodiment of the tamperproof food box in an open state, in accordance with the present invention.

As illustrated in FIGS. 4 and 5, the food container 50 has an upper or lid portion 52 and a lower or bottom portion 54 that are hinged together. The upper portion 52 forms a top half of the container 50, while the lower portion 54 forms the bottom half, or the base, of the container 50. The upper portion 52 has an upper panel 56 from which an upper wall 58 extends. The upper wall 58 includes rear upper wall 58*a*, front upper wall 58*b*, and first and second upper side walls 58*c* and 58*d* which are interconnected. The lower portion 54 has a bottom panel 60 from which the lower wall 62 extends. The lower wall 62 includes rear lower wall 62*a*, front lower wall 62*b*, and first and second lower side walls 62*c* and 62*d* which are interconnected. The food container 50 has a unique drip containment. The lower portion 54 can include a series of spaced, custom ridges 55 onto which the food is placed to help reduce the amount of moisture absorbed by the food by allowing water, sauce, etc. to collect between the ridges as the food is elevated above.

The upper portion 52 and the lower portion 54 of the container 50 are connected by a hinge 64 located between the rear lower wall 62*a* attached to the bottom panel 60 and the rear upper wall 58*a* attached to the top panel 56. The hinge 64 allows the upper portion 52 of the container 50 to fold onto the lower portion 54, thereby permitting the container to close and open. The upper walls 58 of the upper portion 52 define an upper lip 66 around its edges distal from the top panel 56. The upper lip 66 extends outward from the upper wall 58. Similarly, lower wall 62 define a lower lip 68 around its edges distal from the bottom panel 60 of the lower portion 54. When the upper portion 52 is rotated about the hinge 64 and is thus closed on the lower portion 54 of the container 50, the upper lip 66 abuts against the lower lip 68, as shown in FIG. 4.

A cover flap 70 is attached to the front upper wall 58*b* that is attached to the top panel 56. The cover flap 70 corresponds and fits within a retainer slot 72 within the lip 68 of front lower wall 62*b* that is attached to the bottom surface 60. There will be a plurality of adhesive strips 74*a*, 74*b* and 74*c* disposed on the lower lip 68 and if desired, an adhesive strip 74*d* on the underside of the cover flap 70. Each of the strips of adhesive 74*a*, 74*b*, 74*c* and 74*d* can be covered with a removable strip of non adhesive liner 75*a*, 75*b*, 75*c*, and 75*d*, respectively. Just before the food container is closed, the strips of non adhesive liner 75*a*, 75*b*, and 75*c* are removed from the strips of adhesive 74*a*, 74*b*, and 74*c*. Then, when the upper lip 66 abuts against the lower lip 68 and they are pressed together, the upper portion 52 and the lower portion 54 of the container 50 are sealed closed with the adhesive so that no one may tamper with the food therein until the box reaches the final consumer.

As shown in FIG. 4, when the food container 50 is closed, cover flap 70 may be inserted through the retainer slot 72 within the front panel 62*b* to ensure that the food container remains closed. After the non adhesive liner 75*d* (not shown) is removed from the adhesive strip 74*d*, the cover flap can be pressed against the front lower wall 62*b* to seal the upper portion 52 and the lower portion 54 of the container 50 closed so that no one may tamper with the food therein until the food container reaches the final consumer. It is within the terms of the present embodiment to close the food container solely with the cover flap 70 inserted through the retainer slot 72, pressed against the front lower wall 62*b* and sealed thereto with the adhesive. This closes the upper portion 52 and the lower portion 54 of the container 50 so that no one may tamper with the food therein until the food container reaches the final consumer. It is also within the terms of the present embodiment to provide a bonding agent on the interior surface of the cover flap and the front lower wall 62*b* to seal the cover flap to the front lower wall when they are pressed against each other.

As illustrated in FIGS. 4 and 5, preferably there is a perforation 76 disposed along the upper wall 58 including the front upper wall 58*b*, and first and second upper side walls 58*c* and 58*d*, preferably adjacent to the upper lip 66 extending outward from the upper wall. The perforation 76 forms a tear strip 78 to provide easy tearing in a direction generally transverse to the tear strip. The tear strip 78 is designed to tear open consistently, with a relatively uniform tearing force, without excessive distortion of the perforation 76. The tear strip can include a pull tab 82 that snaps off.

As illustrated in FIG. 5, on the interior surface of the upper wall including the first upper side wall 58*c*, front upper wall 58*b* and second upper side wall 58*d* is a continuous length of material, such as plastic or string, 80. The material 80 extends about three sides of the food container 50 and is directly behind the tear strip 78. A pull tab 82 is attached to one end of the material 80. The pull tab 82 is preferably at a location adjacent the upper side wall 58*a*. Alternatively, as seen in FIG. 5, there may be a another pull tab 83 attached to a second end of the material 80 at a location adjacent to the intersection of the upper side wall 58*a* and the second upper side wall 58*c*. To tear through the tear strip 78, the pull tab 82 is raised by a user, thereby lifting the material 80 such that it separates the tear strip.

Figure 6:
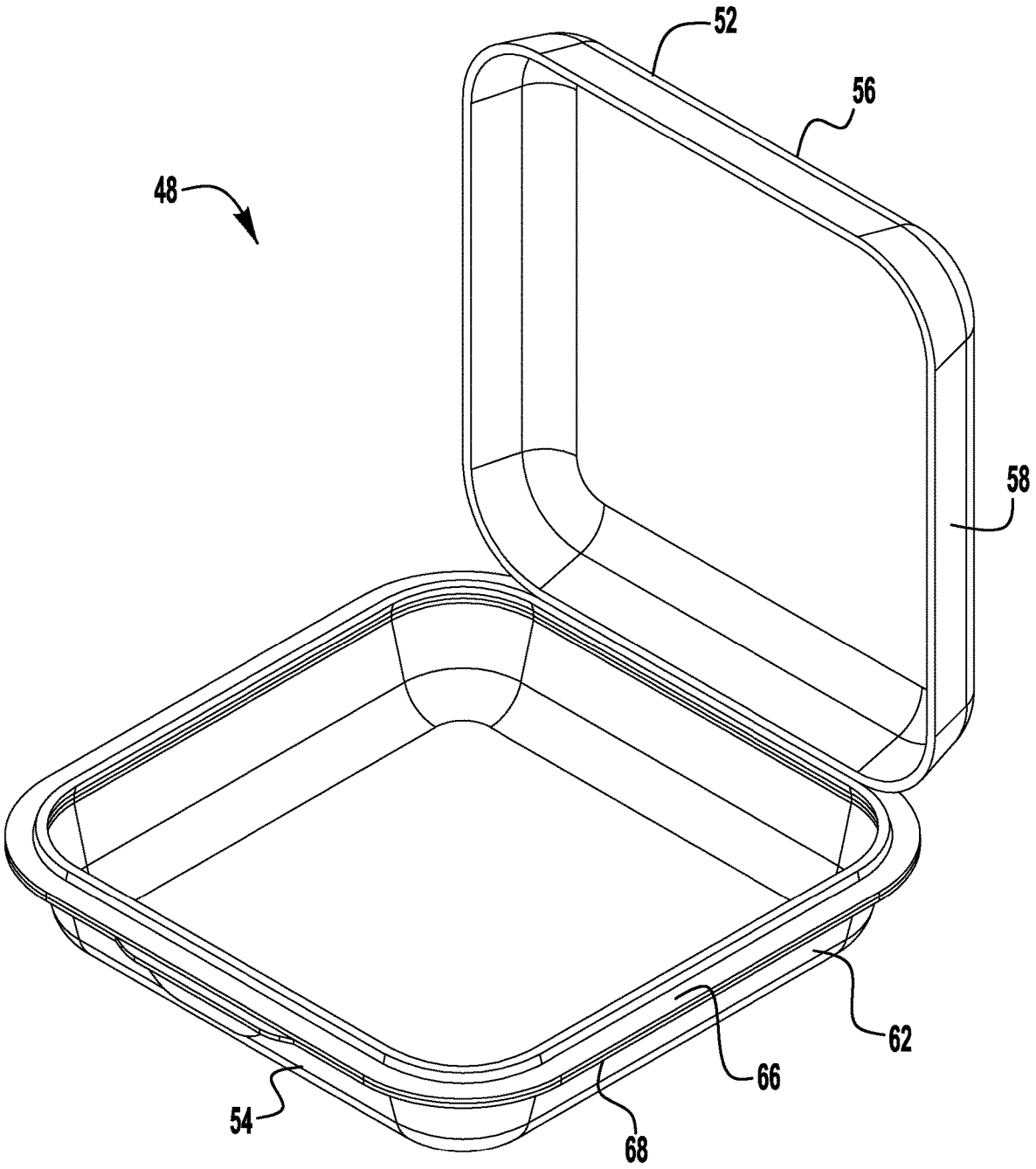
FIG. 6 is a front three dimensional view of an alternative embodiment of the tamperproof food box after it has been opened along the tear strip, in accordance with the present invention.

When the tear strip 78 is torn, the top surface 56 and the upper wall 58 are separated from the upper and lower lips 66 and 68, respectively, which are adhesively connected to each other as shown in FIG. 6. It is also within the terms of the preferred embodiment to invention to provide a tear strip that encircles the upper wall 58 so that when the tear strip is torn, the food container 50 is separated into two pieces, i.e., the upper portion 52 and the lower portion 54. In use, the food is placed within the food container 50, then the food container is closed and sealed together so that no one may tamper with the food therein until the food container reaches the final consumer and it is opened using the material 80 to separate the tear strip 78. After the lid is opened, the upper portion can re-close with the bottom portion in a way that secures the top portion, such as with tape or an adhesive.

Figure 7:
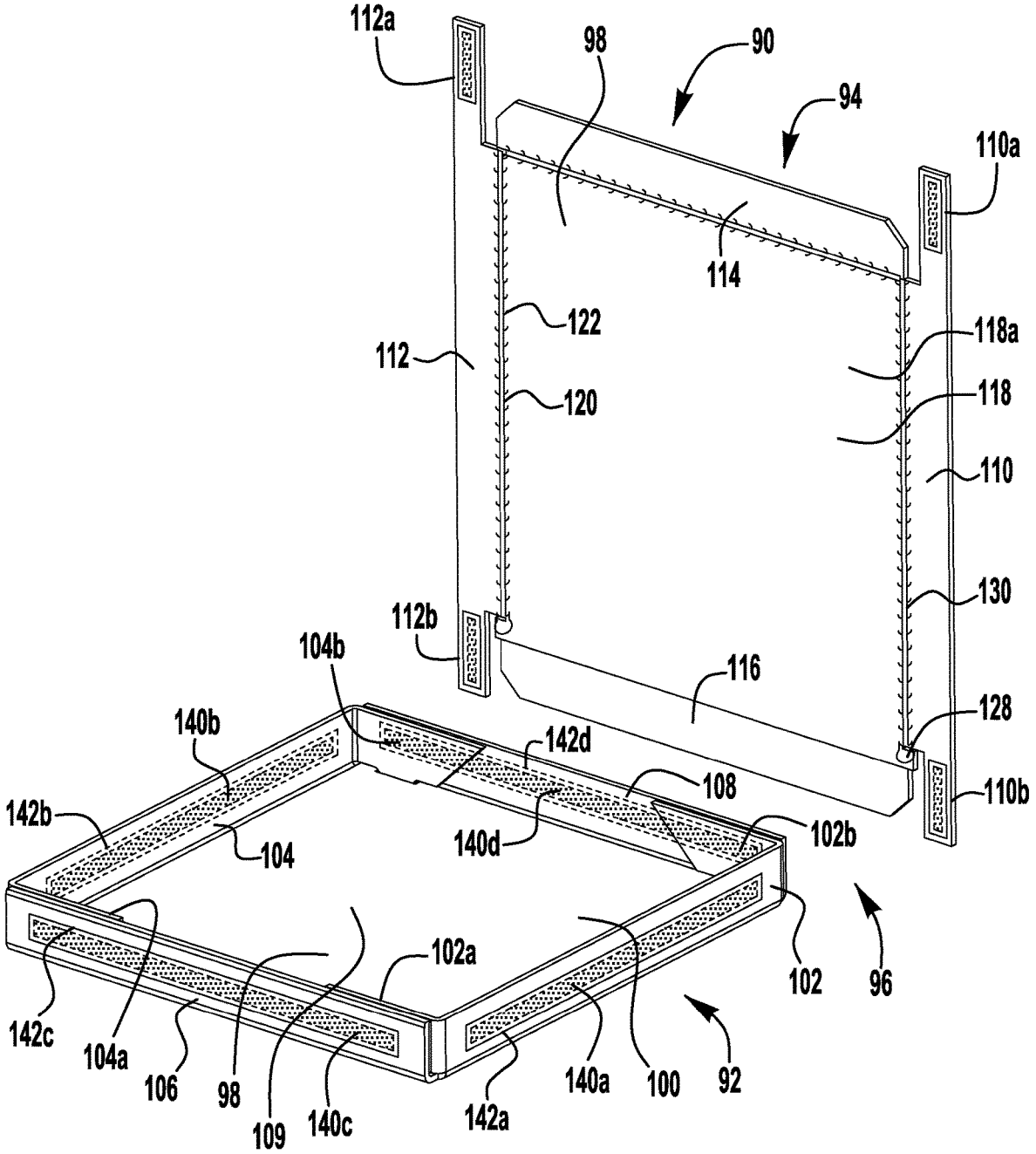
FIG. 7 is a front three dimensional view of an alternative embodiment of the tamperproof food box having a separate bottom and lid, in accordance with the present invention.

FIG. 7 illustrates an alternative embodiment of a tamperproof food box 90 constructed with a bottom 92 and a separate lid or top 94. The object of the tamperproof food box 90 is to provide an improved re-closable folding box with a tamper-evident closure. While FIG. 7 illustrates a three-dimensional view of an alternative embodiment of a food container, wherein the tamperproof food box 90 can be a pizza box 96, any food delivery container may be utilized. Typically, the pizza box 96 is constructed of two sheets of material, such as a corrugated paper material, cardboard, paperboard, plastic or any other material that may creased, folded and bonded, that is suitably rigid for storing food items. Further, the assembled pizza box 96 may be of any suitable dimensions, such as for example 15 inches by 15 inches by 2 inches. However, it should be noted that the food container 90 shown as a tamperproof food box, may include any desired type of food container with any appropriate dimensions. The food container 96, as with all of the other food container boxes disclosed herein has a unique drip containment.

As seen in FIG. 7, the top 94 and bottom 92 of the tamperproof food box 90 consists of first and second main panels 98 and 100, respectively, which are can be assembled together when the top and bottom 94 and 92 are formed into the tops and bottoms of the boxes. Typically, the tops and bottoms of the tamper proof box 90 are shipped to a food establishment flattened and unassembled.

To fold and assemble the bottom 92, the two side panels 102 and 104 and the front and rear panels 106 and 108 are first folded upwardly from the bottom panel 109. The side panels 102 and 104 may each include folding corner tabs, such as corner tabs 102*a* and 102*b* attached to side panel 102 and corner tabs 104*a* and 104*b* attached to side panel 104, which are formed on ends of the side panels are hinged, fold inside, and support the sides and corners of the bottom 92. Then, the two side panels 102 and 104, and the front and rear panels 106 and 108 are simply secured to the corner tabs 102*a*, 102*b*, 104*a* and 104*b* such as by an adhesive to form the bottom 92 of box 90.

To fold and assemble the top 94, the two side panels 110 and 112 and the front and rear panels 114 and 116 are first folded upwardly from the top panel 118. The side panels 110 and 112 may each include folding corner tabs, such as corner tabs 110*a* and 110*b* attached to side panel 110 and corner tabs 112*a* and 112*b* attached to side panel 112, which are formed on ends of the side panels to hinge, fold inside, and support the sides and corners of the top 94 of box 90. Then, the two side panels 110 and 112, and the front and rear panels 114 and 118 are simply secured to the corner tabs 110*a* and 110*b* 112*a*, and 112*b* such as by an adhesive to form the top 94 of box 90.

As illustrated in FIG. 7, the food container 90 incorporates a sealing method of securing the top 94 to the bottom 92 after the top and bottom have been constructed. This sealing method is preferably done with strips of an adhesive, such as an adhesive glue that is preferably bio-green i.e., environmentally friendly. Typically, a strip of adhesive 140*a*, 140*b*, 140*c* and 140*d* is disposed on the outer facing side of side panels 102 and 104, respectively, and front and rear panels 106 and 108, respectively. Each of the strips of adhesive 140*a*, 140*b*, 140*c* and 140*d* are covered with a removable strip of non adhesive liner 142*a*, 142*b*, 142*c*, and 142*d*, respectively. When the food container 90 is constructed, the strips of non adhesive liner 142*a*, 142*b*, 142*c*, and 142*d* are removed from the strips of adhesive 140*a*, 140*b*, 140*c* and 140*d*, respectively. Then, when the two side panels 110 and 112, and front and back panels 114 and 116 of the top 94 are pressed against the side panels 102 and 104 and front and rear panels 106 and 108, respectively, of the bottom 92 they are secured together with the strips of adhesive 140*a*, 140*b*, 140*c* and 140*d*. The purpose of the securely fastening the top 94 to the bottom 92 is that once the box 90 has been sealed closed with the adhesive, no one may tamper with the food therein until the box reaches the final consumer.

As illustrated in FIG. 7, preferably there is a perforation 120 that surrounds the food container 90, specifically around a portion of the second main or lid panel 100, preferably adjacent to the two side panels 110 and 112, and front panel 114. The perforation 120 forms a tear strip 122 to provide easy tearing in a direction generally transverse to the tear strip. The tear strip 122 is designed to tear open consistently, with a relatively uniform tearing force, without excessive distortion of the perforation 120. The tear strip 122 can include a pull tab 124 that snaps off.

Figure 8:
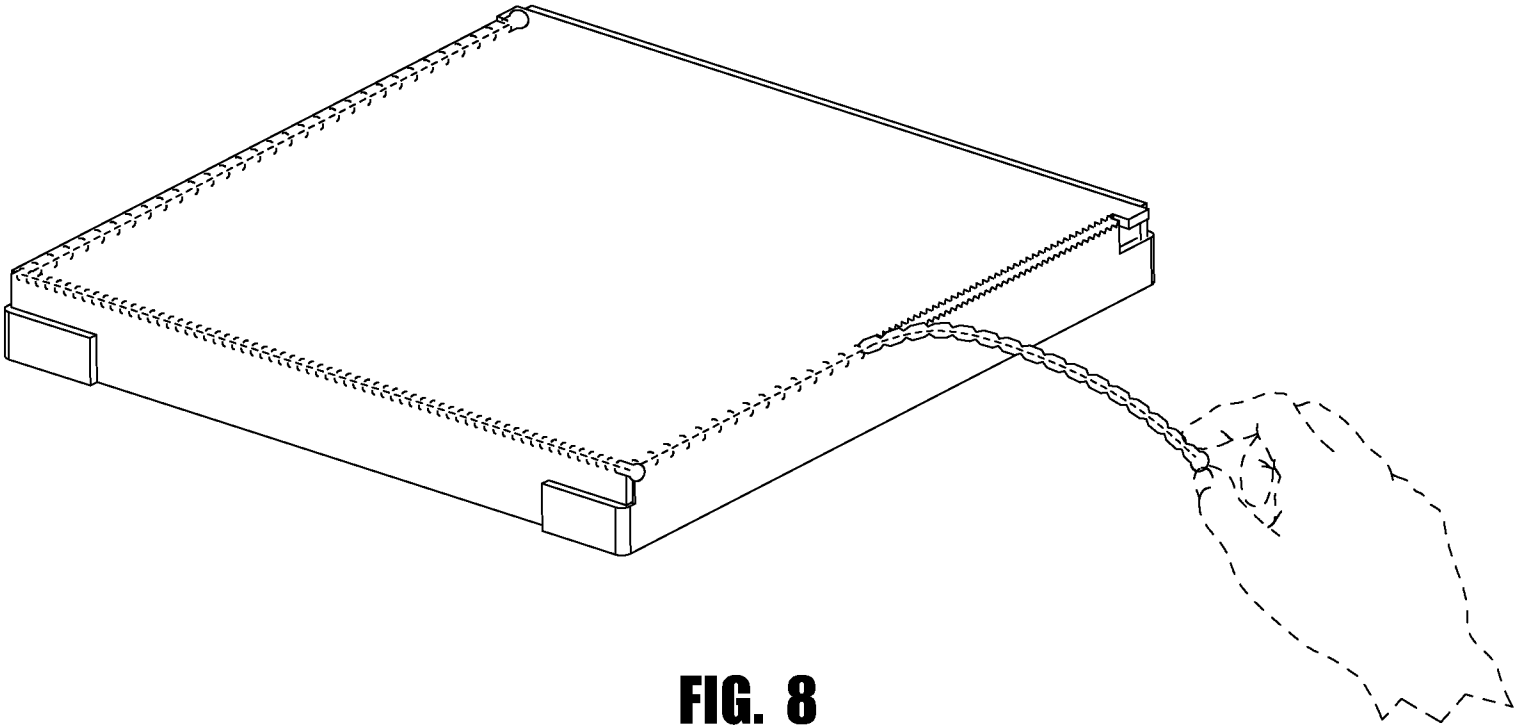
FIG. 8 is a front three dimensional view of the tamperproof food box of FIG. 7 in an assembled condition, in accordance with the present invention.

When the box 90 is assembled, as shown in FIG. 8, the tear strip 122 can be disposed on the second main panel 118 directly above the two side panels 110 and 112, and front panel 114. It's also within the scope of the embodiment of FIG. 7 for perforation 120 to extend completely around the second main or lid panel 100, preferably adjacent to the two side panels 110 and 112, the front panel 114 and the rear panel 118.

As illustrated in FIG. 7, on the interior surface 118*a* of the lid panel 118 adjacent to the two side panels 110 and 112, and front panel 114, respectively, is a continuous length of material, such as plastic or string 130. The material 130 extends about at least three sides of the food container 90 and is secured to the interior surface 118*a* directly below the tear strip 122. A pull tab 124 is attached to an end of the material 130. The pull tab 124 is preferably located below a first end of side panel 110, or below a first end of side panel 112. To tear through the tear strip 122, the pull tab 124 is raised by a user 48, as shown in FIG. 8 (compare FIG. 1), thereby lifting the material 130 such that it separates the tear strip 122. Although a pull tab 124 is shown, any desired means of lifting the material 130 to tear the tear strip 122 may be utilized, such as a loop attached to the material.

Figure 9:
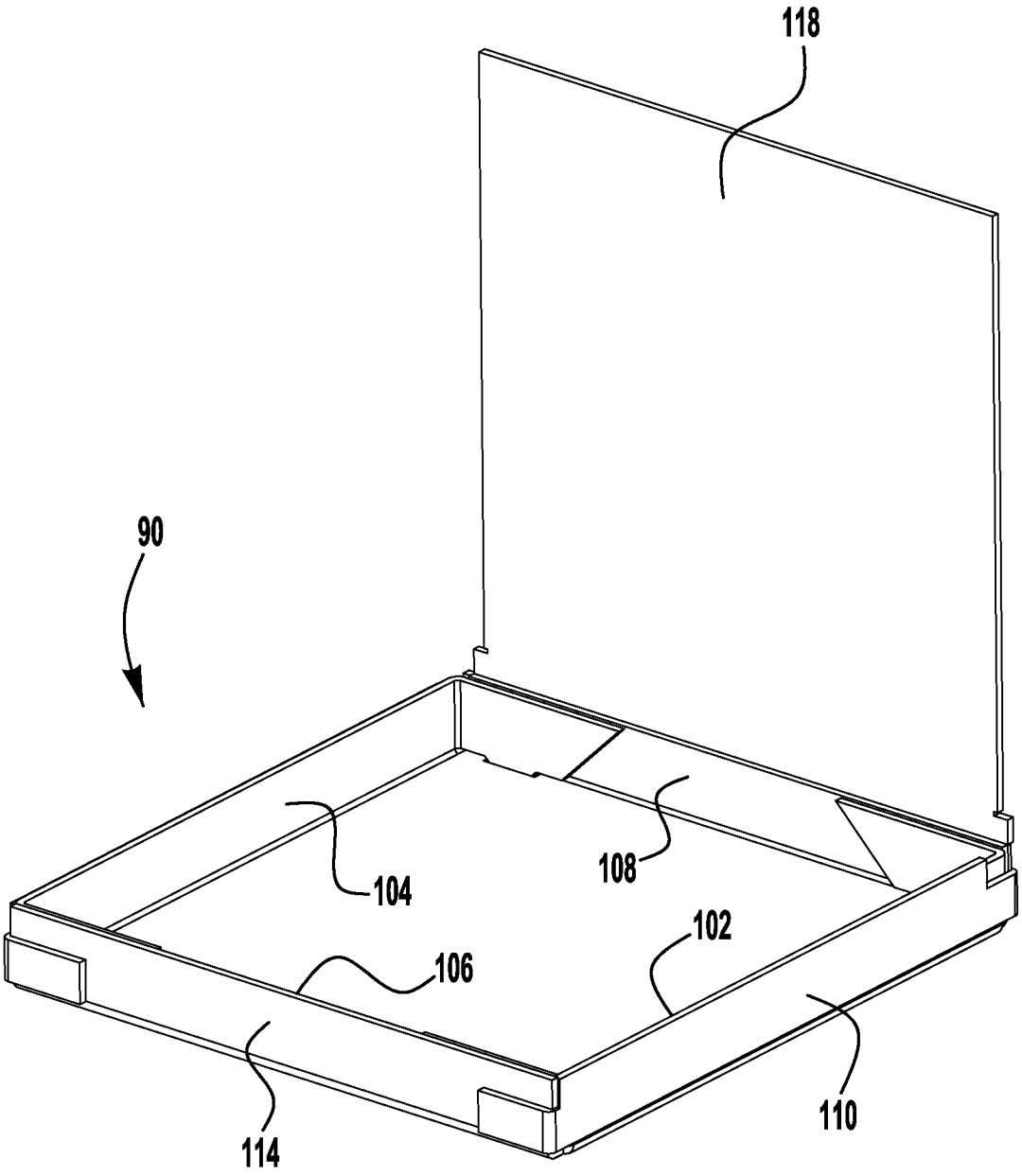
FIG. 9 is a front three dimensional view of the tamperproof food box of FIG. 8 with only the lid panel opened, in accordance with the present invention.

As shown in FIG. 9, after the box 90 is assembled, the tear strip 122 can be torn by pulling tab 124 and lifting the material 130 such that it separates the tear strip. FIG. 9 shows only the lid panel 118 opened to remove the food therein whereby the user may be assured that the food has not been tampered with.

Figure 10:
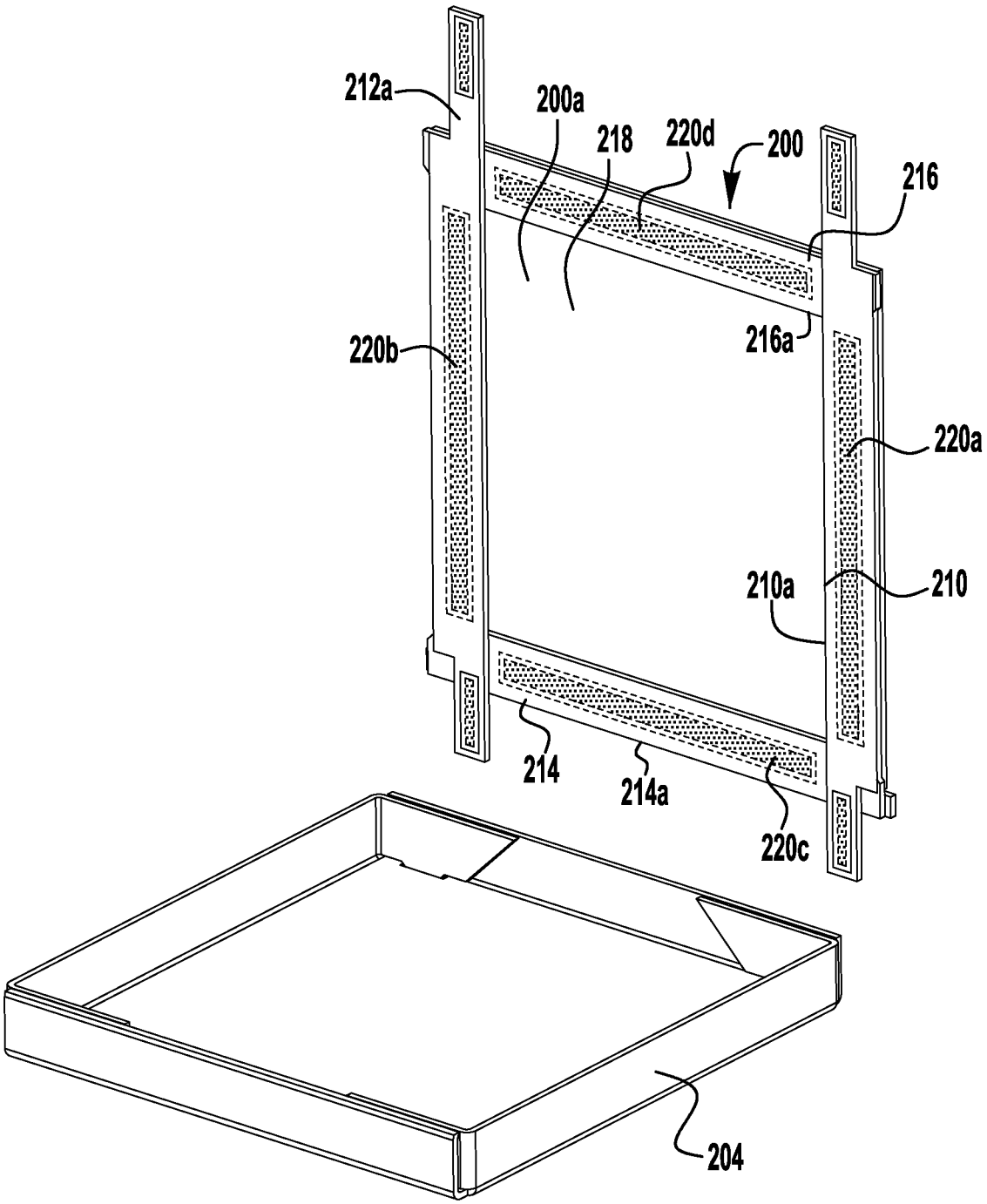
FIG. 10 is a front three dimensional view of an alternative embodiment of the tamperproof food box where the front, side and rear panels the lid panel are disposed against the lid panel prior to the lid being assembled, in accordance with the present invention.

Referring to FIG. 10, there is shown an alternative embodiment of FIG. 7 where the two side panels 210 and 212, the front panel 214 and the rear panel 218 of the lid panel 200 are disposed against the lid panel 218 prior to the lid being assembled. In this case, the strips of adhesive 220*a*, 220*b*, 220*c*, and 220*d* are placed on the inner surface 210*a* and 212*a* of the two side panels 210 and 212, and on the inner surface 214*a* and 218*a* of the front panel 214 and the rear panel 218. The adhesive is prevented from sticking onto the inner surface 200*a* of the lid panel 200 by providing a non-stick surface on the inner surface. Alternatively, the strips of adhesive 220*a*, 220*b*, 220*c*, and 220*d* could be covered with a removable strip of non adhesive liner. In this embodiment, the strips of adhesive would not be needed on the bottom 204 as shown in FIG. 7. The provision of folding the side and front panels of a lid panel could also be used with the embodiment of FIG. 7.

Figure 11:
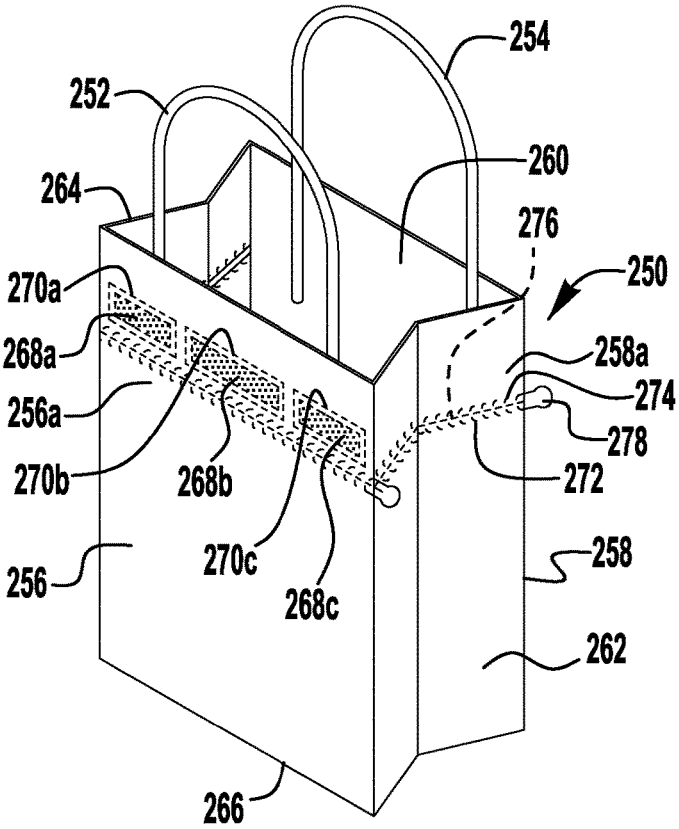
FIG. 11 is a front three dimensional view of an alternative embodiment of a tamperproof large handle bag, in accordance with the present invention.

Referring to FIG. 11, there is illustrated an alternative embodiment comprising a tamperproof large handle bag 250 into which other food delivery containers may be placed. Typically, the bag 250 is constructed of a single sheet of material, such as for example, paper, kraft paper, paperboard, a corrugated paper material, plastic or any other material that may folded and bonded and that is suitably strong for transporting storing food items. The bag 250 can have handles 252,254 secured to opposite sides 256 and 258 of the bag and extending out from the open end 260 of the bag. The opposite sides 256 and 258 of the bag 250 can be interconnected with side panels 262 and 264. Further, the bag 250 may be of any suitable dimensions.

As seen in FIG. 11, the tamperproof bag 250 consists of first and second main panels 256 and 258, respectively, which are connected by side panels 262 and 264 and a bottom panel 266. The tamperproof bag 250 can include a clear side window and/or vents in one or both of the main panels (not shown) and vents in the top or side panels.

Returning to FIGS. 11 and 12, the tamperproof bag 250 incorporates a sealing method of securing the upper ends 256*a* and 258*a* of main panels 256 and 258. This sealing method is preferably done with strips of an adhesive, such as an adhesive glue that is preferably bio-green i.e., environmentally friendly. Typically, a strip of adhesive 268*a*, 268*b*, and 268*c* is disposed on the inner surface 256*a* of the panel 256 and adapted to seal against the inner surface 258*a* of the panel 258. Each of the adhesive strips 268*a*, 268*b*, and 268*c* are covered with a removable strip of non adhesive liner 270*a*, 270*b*, and 270*c*, respectively.

There is a perforation 272 that extends across the panel 256, closer to the end 256*a* and across both side panels 262 and 264. The perforation 272 forms a tear strip 274 to provide easy tearing in a direction generally transverse to the tear strip. The tear strip 274 is designed to tear open consistently, with a relatively uniform tearing force, without excessive distortion of the perforation 272. On the interior surface of the panel 256 and both side panels 262 and 264 is a continuous length of material, such as plastic or string 276. The material 276 extends about the panel 256 and both side panels 262 and 264 and is secured to their interior surfaces directly below the tear strip 274. A pull tab 278 is attached to an end of the material 276.

After food delivery containers or other items are placed within the tamperproof bag 250, the strips of non adhesive liner 270*a*, 270*b*, and 270*c* are removed from the strips of adhesive 268*a*, 268*b*, and 268*c*. Then, the upper ends 256*a* and 258*a* of main panels 256 and 258 are pressed into contact with each other and are secured together with the strips of adhesive 268*a*, 268*b*, and 268*c*. The purpose of the securely sealing closed the tops of the main panels 256 and 258 together is so no one may tamper with the food containers or other contents therein until the bag reaches the final consumer.

Figure 12:
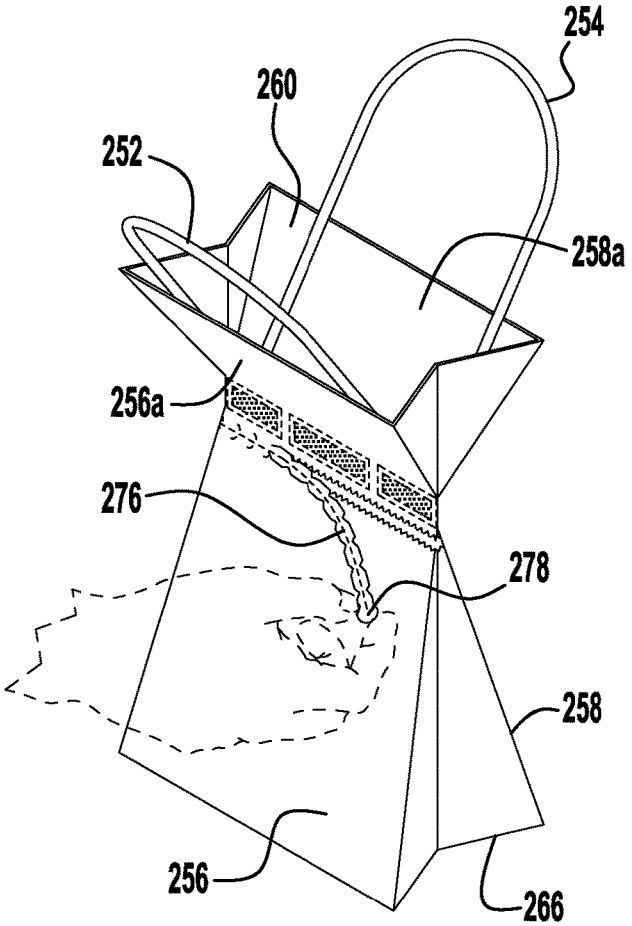
FIG. 12 is a front three dimensional view of an alternative embodiment of a partially opened tamperproof large handle bag, in accordance with the present invention.

As shown in FIG. 12, after the bag 250 is assembled, the tear strip 274 can be torn by pulling tab 276 and lifting the material 276 such that it separates the tear strip. FIG. 12 shows the bag 250 partially opened to remove the food delivery containers and/or other items therein whereby the user may be assured that the containers and/or other items have not been tampered with. After the bag is opened, it can re-close in a way that secures the upper end 256*a* with the remainder of the main panel 256, such as with tape or an adhesive. The bag can also include a fold over flip top.

Note that each of the containers and bags disclosed herein can have different sealing locations depending on size and shape of the container and the bag. Also, the containers, boxes and bags disclosed hereinbefore can incorporate a sealing material or adhesive that doesn't require protective wax tape because the sealing material will be tucked under a specific flap then exposed when needed and applied to a specific section of the packaging designed to receive the sealing material.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A re-closable tamperproof food box having a tamper-evident closure, comprising:

first and second main panels being connected with a rear panel, the first main panel forming the bottom of the food box and the second main panel forming the top of the food box;

the first main panel having two opposing side panels attached to first and second edges of the first main panel and a front panel attached to a third edge of the first main panel;

the second main panel having two opposing side panels attached to first and second edges of the second main panel and a front panel attached to a third edge of the second main panel;

the second main panel being connected along fourth edge to the rear panel connected along a fourth edge of the first main panel;

at least one strip of adhesive disposed on one of the two opposing side panels and the front panel of the first main panel;

a perforation disposed along the second main panel, coincident with said first, second and third edges of said second main panel, forming a tear strip; and a continuous length of material, comprising one of plastic and string, on an interior surface of the second main panel adjacent to the two opposing side panels and the front panel of the second main panel, extending about at least three sides of the food box and secured to the interior surface directly below the tear strip, to tear through the tear strip.

2. The tamperproof food box of claim 1 wherein, the two side panels and front panel of the first main panel are folded upwardly from the first, second and third edges of the first main panel; and the two side panels and front panel of the second main panel are folded downwardly from the first, second and third edges of the second main panel.

3. The tamperproof food box of claim 2 wherein, at least one strip of adhesive is disposed on the two opposing side panels and the front panel of the first main panel, whereby when the two side panels and front panel of the first main panel are pressed against the side panels and the front panel of the first second main panel, respectively, they are secured together with the strips of adhesive.

4. The tamperproof food box of claim 3 wherein each of the at least one strip of adhesive is covered with a removable strip of non adhesive liner.

5. The tamperproof food box of claim 1 constructed of a single sheet of material.

6. The tamperproof food box of claim 5 formed from a group consisting of corrugated paper material, cardboard, paperboard, and plastic.

7. The tamperproof food box of claim 1 wherein a pull tab is attached to an end of the continuous length of material, for lifting the length of material such that it separates the tear strip.

8. The re-closable tamperproof food box of claim 1 further comprising a vent.

9. The re-closable tamperproof food box of claim 8 further comprising a vent in said second main panel.

10. A re-closable tamperproof take-out food container having a tamper-evident closure, comprising:

an upper portion forming a top half of the container and a lower portion forming the bottom half of the of the container, being hinged together;

an upper panel of the upper portion from which an upper wall extends, the upper wall including a rear upper wall, a front upper wall, and first and second upper side walls which are interconnected;

a bottom panel of the lower portion from which a lower wall extends, the lower wall including rear lower wall, a front lower wall, and first and second lower side walls which are interconnected;

a hinge located between the rear lower wall attached to the bottom panel and the rear upper wall attached to the top panel for connecting the upper portion and the lower portion, whereby the upper portion folds onto the lower portion;

at least one strip of adhesive disposed on one of the first and second lower side walls and the front lower wall;

a perforation disposed across a fold joining said front upper wall and said upper panel, said perforation also disposed across folds joining said first and second upper side walls and said upper panel, forming a tear strip; and a continuous length of material, comprising plastic or string, on an interior surface of the upper wall including the front upper wall, and the first and second upper side walls, extending about three sides of the food container and is directly behind the tear strip, to tear through the tear strip wherein said continuous length of material has a width extent substantially less than a width of said tear strip.

11. The re-closable tamperproof take-out food container of claim 10 further comprising a vent.

12. A re-closable tamperproof food box having a tamper-evident closure, comprising:

first and second main panels which form the top and bottom of the box;

the first main panel including two side panels, and front and rear panels folded upwardly from a bottom panel to form the bottom of the box;

the second main panel including two side panels, and front and rear panels folded downwardly from a top panel to form the top of the box;

at least one strip of adhesive disposed on the two side panels, the front panel and the rear panel of the bottom of the box whereby when the two side panels and the front and rear panel of the top of the box are pressed against the side panels, the front panel and rear panel of the bottom of the box, the top of the box is secured to the bottom of the box;

a perforation spanning folds between said top panel and said side and front panels of said second main panel, forming a tear strip; and a continuous length of string material on an interior surface of the second main panel adjacent to the two side panels and the front panel of the second main panel, extending about at least three sides of the food box and secured to the interior surface directly below the tear strip, configured to tear through the tear strip.

13. The tamperproof food box of claim 12 wherein each of the at least one strip of adhesive is covered with a removable strip of non adhesive liner.

14. The re-closable tamperproof food box of claim 12 further comprising a vent in at least two of said second main panel, said two side panels of said second main panel, said rear panel of said second main panel, and said front panel of said second main panel.

15. A re-closable tamperproof food box having a tamper-evident closure, comprising:

first and second main panels which form the top and bottom of the box;

the first main panel including two side panels, and front and rear panels folded upwardly from a bottom panel to form the bottom of the box;

the second main panel including two side panels, and front and rear panels folded against an inner surface of a lid panel and then folded downwardly to form the top of the box;

at least one strip of adhesive disposed on an inner surface of the two side panels, the front panel and the rear panel of the top of the box whereby when the two side panels and the front and rear panel of the top of the box are pressed against the side panels, the front panel and rear panel of the bottom of the box, the top of the box is secured to the bottom of the box;

a perforation disposed along the second main panel, disposed against the two side panels, and disposed against the front panel of the second main panel, forming a tear strip; and a continuous length of material, comprising plastic or string, on an interior surface of the second main panel adjacent to the two side panels and the front panel of the second main panel, extending about at least three sides of the food box and secured to the interior surface directly below the tear strip, to tear through the tear strip, wherein said continuous length of material is configured to apply a force sufficient to tear through the tear strip.

16. The tamperproof food box of claim 15 wherein each of the at least one strip of adhesive is covered with a removable strip of non adhesive liner to prevent each of the at least one strip of adhesive from sticking onto the inner surface of the lid panel.

17. The tamperproof food box of claim 15 further including providing a non-stick surface on the inner surface of the lid panel to prevent each of the at least one strip of adhesive from sticking onto the inner surface of the lid panel.

18. The tamperproof food box of claim 15 wherein a pull tab is attached to an end of the continuous length of material, for lifting the length of material such that it separates the tear strip.

19. The re-closable tamperproof food box of claim 15 further comprising a vent.

20. The re-closable tamperproof food box of claim 19 further comprising a vent in at least one of said side panels.

* * * * *